US009834403B2

(12) United States Patent
Barea

(10) Patent No.: US 9,834,403 B2
(45) Date of Patent: Dec. 5, 2017

(54) METHOD AND DEVICE FOR WINDING A SYNTHETIC YARN COMING FROM AN EXTRUDER

(71) Applicant: BTSR INTERNATIONAL S.P.A., Olgiate Olona (Varese) (IT)

(72) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 133 days.

(21) Appl. No.: 14/395,904

(22) PCT Filed: Apr. 29, 2013

(86) PCT No.: PCT/IB2013/053368
§ 371 (c)(1),
(2) Date: Oct. 21, 2014

(87) PCT Pub. No.: WO2013/164749
PCT Pub. Date: Nov. 7, 2013

(65) Prior Publication Data

US 2015/0129705 A1 May 14, 2015

(30) Foreign Application Priority Data

May 3, 2012 (IT) ..... MI2012A0734

(51) Int. Cl.
*B65H 59/38* (2006.01)

(52) U.S. Cl.
CPC ... *B65H 59/385* (2013.01); *B65H 2701/3132* (2013.01)

(58) Field of Classification Search
CPC ..... B65H 59/384; B65H 59/385
See application file for complete search history.

(56) References Cited

U.S. PATENT DOCUMENTS 3,931,938 A * 1/1976 Hasegawa ..... B65H 59/385 242/413.3
4,566,642 A * 1/1986 Sommer ..... B65H 59/385 242/486.7

(Continued)

FOREIGN PATENT DOCUMENTS

CN 201722012 U 1/2011
CN 201961901 U 9/2011

(Continued)

OTHER PUBLICATIONS

Office Action dated Jan. 29, 2016 from Chinese Patent Application No. 201380023036.5 to BTSR International S.p.A.

(Continued)

*Primary Examiner* — William E Dondero
(74) *Attorney, Agent, or Firm* — Vorys, Sater, Seymour and Pease LLP

(57) ABSTRACT

A method for winding a synthetic yarn coming from an extruder including the steps of connecting at least one yarn exiting from an extruder with at least one corresponding bobbin rotatable around a longitudinal axis thereof, on which the yarn is wound; rotating the bobbin by imparting a specific speed and/or torque to the bobbin; measuring a value of the tension acting on the yarn upstream of the bobbin; adjusting the speed and/or the torque to maintain the measured tension value substantially equal to a constant reference value of the tension.

17 Claims, 1 Drawing Sheet

(56) References Cited

U.S. PATENT DOCUMENTS

| | | | | |
|---|---|---|---|---|
| 4,566,646 | A | 1/1986 | Benjamin | |
| 5,277,373 | A | 1/1994 | Morton | |
| 2005/0133653 | A1 * | 6/2005 | Heaney | B65H 49/02 242/410 |

FOREIGN PATENT DOCUMENTS

| | | | | |
|---|---|---|---|---|
| CN | 202130926 | U | 2/2012 | |
| DE | 2412153 | A1 | 10/1975 | |
| EP | 0875479 | A1 | 11/1998 | |
| EP | 0933322 | A2 | 8/1999 | |
| FR | EP 0610144 | A1 * | 8/1994 | B65H 51/30 |
| GB | 1110718 | A * | 4/1968 | B65H 59/385 |

OTHER PUBLICATIONS

International Search Report and Written Opinion dated Sep. 4, 2013 for PCT/IB2013/053368 to BTSR International S.P.A. filed Apr. 29, 2013.

* cited by examiner

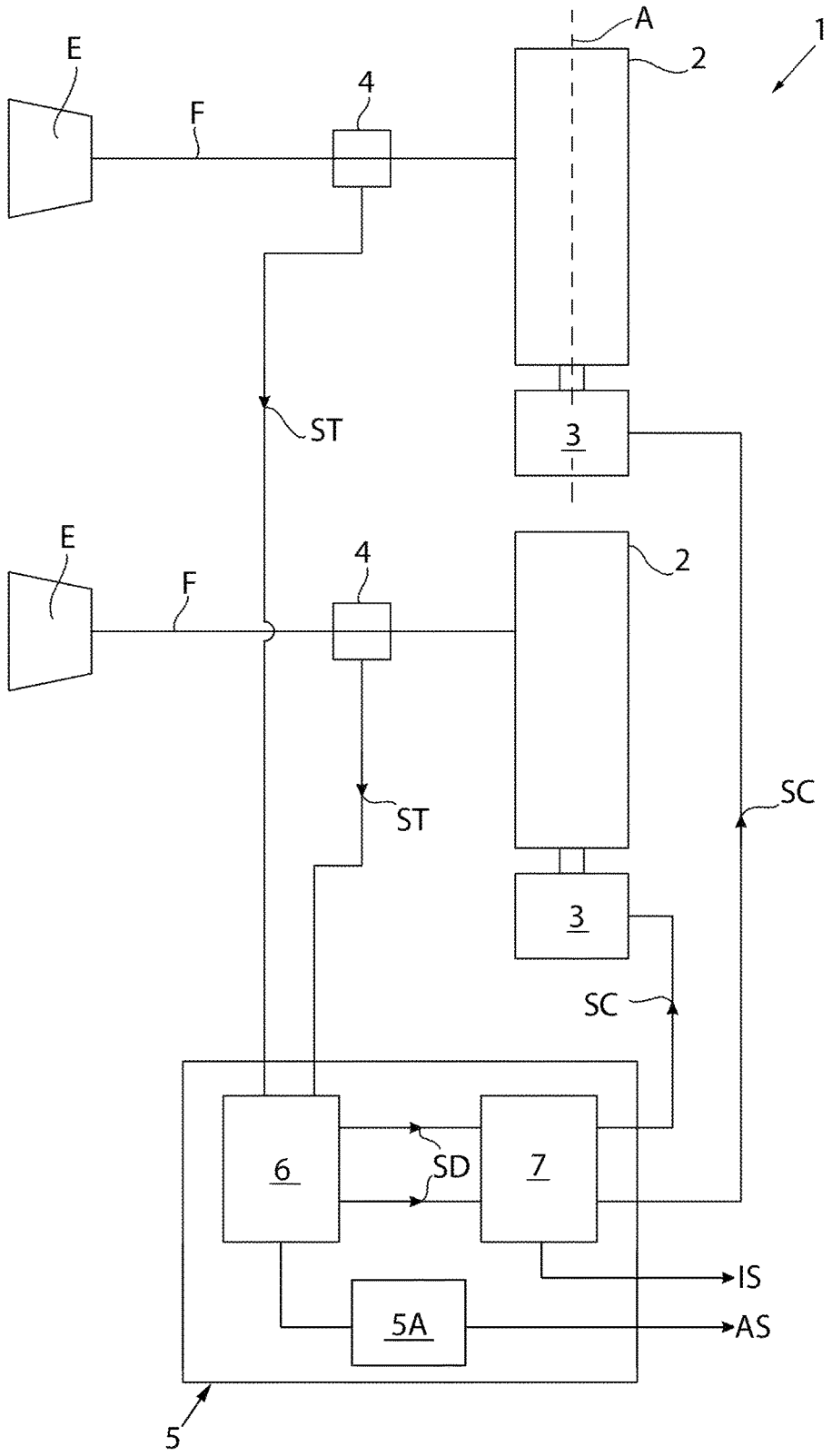
A
1
E
2
4
F
ST
3
E
4
2
F
ST
SC
3
SC
6
SD
7
IS
5A
AS
5

METHOD AND DEVICE FOR WINDING A SYNTHETIC YARN COMING FROM AN EXTRUDER

CROSS-REFERENCE TO RELATED APPLICATIONS

This is a §371 National Stage Application of International Application No. PCT/IB2013/053368 filed on 29 Apr. 2013, claiming the priority of Italian Patent Application No. MI2012A000734 filed on 3 May 2012.

The present invention has as object a method and a device for winding a synthetic yarn coming from an extruder.

In the obtainment of some synthetic yarns, the base polymer material is made to pass through an extruder in order to achieve the spinning. The yarn thus obtained is wound on bobbins that are placed in rotation by a suitable motor.

In known plants, a plurality of extruders is associated with a corresponding plurality of motorized bobbins. Frequently, a single motor is associated with all the bobbins of the plant in order to simultaneously rotate them.

Typically, the rotation speed of the bobbins is determined on the basis of a precise and constant relation with the exiting speed of the yarns from the extruders.

Alternatively, such speed can be adjusted by using mechanical dancer arms, where control electronics use the information of the latter's position to control the motor.

Examples of such method can be seen in GB 1 110 718 and U.S. Pat. No. 5,277,373.

Disadvantageously, during the extrusion step, the exiting speed of the single yarn from the extruder can frequently be inconstant. In addition, the yarn being wound on the bobbin forms a reel with increasing diameter, and this causes an increase of the tangential speed of the yarn on the reel.

The known solutions do not envisage these speed variations, or they are unable to effectively compensate for them.

Consequently, the yarns exiting from the extruder are subjected to over-tension or under-tension which can cause modifications of the mechanical characteristics of the yarns, as well as modifications of the geometric characteristics, such as for example a localized reduction of the yarn diameter.

Of course, such modifications cause imperfections in the fabric originating from the yarns thus extruded and wound.

In this situation, the technical task underlying the present invention is to propose a method and a device for winding a synthetic yarn coming from an extruder which overcome the abovementioned drawbacks of the prior art.

In particular, object of the present invention is to provide a method and a device for winding a synthetic yarn coming from an extruder which reduce the imperfections of the extruded yarns.

The specific technical task and object are substantially achieved by a method and a device for winding a synthetic yarn coming from an extruder comprising the technical characteristics and advantages set forth herein.

Further characteristics and advantages of the present invention will be clearer from the exemplifying and hence non-limiting description of a preferred but not exclusive embodiment of a method and a device for winding a synthetic yarn coming from an extruder, as illustrated in the enclosed FIG. 1 which illustrates a schematic representation of a device for winding a synthetic yarn coming from an extruder in accordance with the present invention.

BRIEF DESCRIPTION OF THE DRAWING

FIG. 1 (the sole FIGURE) shows a device for winding a synthetic yarn coming from an extruder in accordance with the present invention.

DETAILED DESCRIPTION OF THE INVENTION

With reference to the enclosed FIG. 1, a device for winding a synthetic yarn coming from an extruder in accordance with the present invention is indicated in its entirety with the numeral 1.

Preferably, such device 1 operates according to a method for winding a synthetic yarn coming from an extruder in accordance with the present invention.

The device 1 comprises at least one bobbin 2 rotatable around a longitudinal axis "A" thereof, on which a synthetic yarn "F" exiting from an extruder "E" is wound.

Advantageously, the device 1 comprises a plurality of bobbins 2, each rotatable around the respective longitudinal axis "A" in order to wind a respective yarn "F" exiting from a respective extruder "E".

The extruders "E" make up part of a device (not further described) for obtaining synthetic yarns "F".

The rotation of the bobbins 2 is ensured by a plurality of motors 3 associated with the bobbins 2. In detail, each bobbin 2 is connected to a respective motor 3 that rotates the bobbin 2 in question.

The bobbins 2 and the motors 3 can be connected to support structures (not shown).

In accordance with the present invention, the device 1 comprises means for controlling, instant-by-instant, the tension acting on the yarns being wound.

In other words, the device 1 comprises a plurality of tension sensors 4, each being associated with a respective yarn "F".

By way of example, the tension sensors 4 are load cells.

Advantageously, the use of the load cells allows a non-invasive detection of the tension. Indeed, in order to detect the acting tension value, it is necessary to move the yarn "F" onto the load cell with minimal pressure. This causes a negligible deflection of the yarn "F" with respect to its advancing path the creation of a very small increase of the tension or tension value of the yarn "F". The advancing path, for example, can be a direct straight path from each extruder to each respective bobbin, as shown in FIG. 1.

Hence, the use of the load cells allows an instantaneous detection of the tension value. Indeed, the absence of movable parts in the load cells causes a decrease of the system inertia and a quicker detection, thus allowing greater adjustment quality.

The tension sensors 4 are associated with the bobbins 2 and are placed upstream of the bobbins 2 themselves.

More precisely, the tension sensors 4 are operatively placed between the extruders "E" and the bobbins 2.

The tension sensors 4 are mounted on suitable supports (not connected) connected to the support structures.

Each of the tension sensors 4 generates a respective tension signal "ST" representative of the measured value of tension acting on a corresponding yarn "F" on which the sensor is active.

An electronic controller such as at least one processing unit 5 is functionally connected to the tension sensors (load cells) 4 in order to receive the tension signals "ST".

In addition, the processing unit 5 processes a plurality of control signals "SC", each representative of the speed and/or the torque which the respective motor 3 must supply.

Consequently, the processing unit 5 is functionally connected to all the motors 3 in order to send each control signal "SC" to the respective motor 3.

In accordance with the present invention, the control signals "SC" are processed in a manner so as to maintain the measured value of the tension substantially equal to a reference value. Such reference value is set by the user, for example on the basis of the type of yarn being wound. Preferably, such reference tension value is constant. In other embodiments, the reference value is variable. For example, such variable reference value can be a function of the production cycle and in particular it can be a function of the quantity of yarn present on the bobbin 2.

The processing unit 5 comprises a comparison subunit 6 functionally connected to the tension sensors 4 in order to receive the respective tension signals "ST". The comparison subunit 6 compares the measured tension values represented by the tension signals "ST" with the reference value. Following such comparison, the comparison subunit 6 generates non-alignment signals "SD" representative of the difference between each measured tension value and the reference value. In addition, the processing unit 5 comprises a control subunit 7 functionally connected to the comparison subunit 6 in a manner such to receive the non-alignment signals "SD".

The control subunit 7 processes the control signals "SC" as a function of the received non-alignment signals "SD". The control subunit 7 is functionally connected to the motors 3 in a manner so as to transmit the control signals "SC" thereto.

Advantageously, the processing unit 5 can comprise a verification subunit 5A functionally connected to the tension sensors 4 in order to receive the respective tension signals "ST".

The verification subunit 5A compares the detected tension values with at least one threshold value preset by the user. If one or more detected values of the tension exceed the threshold value, an alarm signal "AS" is generated by the verification subunit 5A and is sent to suitable display means (not shown) in order to signal the onset of an irregularity.

The threshold value can coincide with the reference tension value.

In addition to displaying the alarm signal, a stop signal can be generated in a manner so as to stop the device following irregularity.

By way of example, the processing unit 5 is of microprocessor type.

The method for winding a synthetic yarn coming from an extruder in accordance with the present invention comprises the preliminary step of connecting at least one yarn "F" exiting from the extruder "E" to the bobbin 2. Preferably, a plurality of yarns "F" is connected to the corresponding plurality of bobbins 2.

The bobbins 2 are rotated around the longitudinal axis "A" thereof by means of the respective motors 3 in a manner such that the yarns "F" are wound on the bobbins 2, forming reels of yarn. In particular, the bobbins 2 are moved by imparting a specific speed and/or torque thereto.

During the movement step of the bobbins 2, the tension acting on the yarns "F" is measured. Such operation is conducted by means of the use of the tension sensors 4.

The measurement step comprises the steps of generating the tension signals "ST" and sending them to the processing unit 5.

The method also comprises the step of adjusting the speed and/or the torque in order to maintain the measured tension values substantially equal to the constant reference tension value.

In particular, such adjustment step comprises the step of comparing each measured tension value with the reference value in order to determine the difference between each measured value and the reference value.

The comparison step comprises the steps of generating the non-alignment signals "SD", achieved by the comparison subunit 6, and sending such signals to the control subunit 7.

The adjustment step also comprises the step of determining the value of the speed and/or the torque of each bobbin 2.

Such step comprises the step of generating the control signals "SC" and sending them to the respective motors 3.

More in detail, the step of adjusting the speed and/or the torque of the bobbins 2 comprises the step of slowing down the bobbins 2 whose yarn "F" is subjected to a tension with measured value greater than the reference value, until the measured tension value equals the reference value.

Analogously, the step of adjusting the speed and/or the torque of the bobbins 2 comprises the step of accelerating the bobbins 2 whose yarn "F" is subjected to a tension with measured value less than the reference value, until the measured tension value equals the reference value.

A further control step can be provided, with reference to the rotation speed of the bobbins 2.

In detail, the values of the speed represented by the control signals "SC" are compared with at least one speed reference value, in a manner such to verify if one or more of the bobbins 2 rotates at an irregular speed with respect to the other bobbins.

In particular, when one or more of the speed values of the bobbins 2 diverges from the reference value, an irregularity signal is generated.

The reference value can be preset by the user. Alternatively, it can be automatically calculated on the basis of the average speed values of all or some of the bobbins 2.

The invention thus described achieves the pre-established object.

Indeed, since the control of the tension acting on the extruded yarns is conducted instant-by-instant, the value of the tension acting on the yarns will always be substantially equal to the set reference value, and hence will be constant.

This prevents the yarns from being subjected to undesired mechanical stresses which can change the mechanical and size characteristics of the yarns themselves. The extruded synthetic yarns will thus have uniform characteristics.

The bobbins of synthetic yarn thus obtained therefore have superior quality, allowing the optimization of subsequent production processes with a remarkable reduction of processing waste.

The invention claimed is:

1. A method for winding a synthetic yarn coming from an extruder comprising the steps of:

connecting the yarn exiting from the extruder to a respective bobbin, rotatable around a longitudinal axis thereof, onto which the yarn is wound;

rotating the bobbin by a motor configured to wind the yarn onto the bobbin while imparting a specific speed and/or torque onto the bobbin;

actively sensing and measuring a value of tension acting on the yarn upstream of the bobbin by a respective load cell configured for non-invasive detection of the tension with negligible deflection of the yarn from an advancement pathway thereof, thereby generating a respective tension signal (ST);

sending the tension signal (ST) from the load cell to a processing unit, the processing unit receiving the tension signal (ST) and processing and sending, to the motor, a control signal (SC) representative of speed and/or torque supplied by the motor to maintain the value of tension acting on the yarn equal to a reference tension value to control instant-by-instant tension acting on the yarn during winding by controlling the motor and adjusting the speed and/or the torque to maintain a measured tension value substantially equal to the reference tension value.

2. The method according to claim 1, wherein the reference tension value is constant.

3. The method according to claim 1, wherein adjusting the speed and/or the torque comprises comparing the measured tension value of the yarn with the reference tension value and determining a value of speed and/or torque to impart onto the bobbin.

4. The method according to claim 3, wherein determining the value of speed and/or torque to impart onto the bobbin is obtained as a function of a difference between the measured tension value of the yarn and the reference tension value.

5. The method according to claim 1, wherein adjusting the speed and/or the torque comprises slowing down/accelerating the bobbin when the measured tension value is greater than/less than the reference tension value.

6. The method according to claim 1, further comprising: comparing the measured tension value with a threshold value and generating an alarm signal when the measured tension value exceeds the threshold value.

7. The method according to claim 1, wherein the measured tension value of the yarn is determined by means of the load cell located upstream of the bobbin.

8. The method according to claim 1, further comprising: comparing a speed value of the bobbin with a reference speed value to generate an irregularity signal, if the bobbin has a speed different from the reference speed value.

9. The method according to claim 1, wherein a plurality of yarns are wound respectively on a plurality of bobbins;

wherein a plurality of load cells, each associated with a respective bobbin, generate a plurality of tension signals (ST) representative of the value of tension acting on each yarn; and wherein the controller maintains each value of tension substantially equal to the reference tension value for each yarn exiting from respective extruders and being wound on respective bobbins.

10. The method according to claim 9, wherein the processing unit comprises a comparison subunit connected to a control subunit and maintains each value of tension substantially equal to the reference tension value for each yarn exiting from correspondent extruders and being wound on correspondent bobbins by modifying a rotational speed of the bobbins.

11. The method according to claim 1, wherein the load cell provides instantaneous detection of the value of tension and has an absence of moving parts.

12. A device for winding a synthetic yarn coming from an extruder comprising:

a bobbin rotatable around a longitudinal axis thereof, on which the yarn is wound;

a motor associated with the bobbin to rotate the bobbin around the longitudinal axis;

a tension sensor associated with the bobbin and active on the yarn for actively sensing and generating a tension signal (ST) representative of a value of tension acting on the yarn, said tension sensor being a load cell configured for non-invasive detection of the tension with negligible deflection of the yarn from an advancement pathway thereof; and a processing unit for controlling instant-by-instant the tension acting on the yarn during winding by receiving the tension signal (ST) and processing and sending, to the motor, a control signal (SC) representative of speed and/or torque supplied by the motor to maintain the value of tension acting on the yarn equal to a reference tension value.

13. The device according to claim 12, wherein the processing unit comprises a comparison subunit functionally connected to the load cell to receive the tension signal (ST) and compare the tension signal with the reference tension value, the comparison subunit generating a non-alignment signal (SD) representative of a difference between a detected tension value and the reference tension value.

14. The device according to claim 13, wherein the processing unit comprises a control subunit functionally connected to the comparison subunit to receive the non-alignment signal (SD) and generate the control signal (SC) as a function of the non-alignment signal (SD).

15. The device according to claim 12, comprising a plurality of bobbins for respectively winding a plurality of yarns; and a plurality of load cells, each associated with a respective bobbin for generating a plurality of tension signals (ST) representative of the value of tension acting on each respective yarn.

16. The device according to claim 15, wherein the processing unit comprises a comparison subunit connected to a control subunit to maintain the value of tension acting on each respective yarn is substantially equal to the reference tension value for each yarn exiting from correspondent extruders and being wound on correspondent bobbins by modifying a rotational speed of the bobbins.

17. The device according to claim 12, wherein the load cell is configured to provide instantaneous detection of the value of tension and has an absence of moving parts.

* * * * *